US006602329B2

(12) United States Patent
Tomimatsu et al.

(10) Patent No.: US 6,602,329 B2
(45) Date of Patent: Aug. 5, 2003

(54) DUST COLLECTOR

(75) Inventors: Kazutaka Tomimatsu, Kobe (JP); Yasutoshi Ueda, Takasago (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 10/227,843

(22) Filed: Aug. 27, 2002

(65) Prior Publication Data

US 2003/0000388 A1 Jan. 2, 2003

Related U.S. Application Data

(62) Division of application No. 09/635,430, filed on Aug. 10, 2000, now Pat. No. 6,500,240.

(30) Foreign Application Priority Data

Aug. 13, 1999 (JP) ..... 11-228982
May 24, 2000 (JP) ..... 2000-152317

(51) Int. Cl.[7] ..... B03C 3/014

(52) U.S. Cl. ..... 96/27; 55/360; 95/71; 96/53; 239/690; 239/705

(58) Field of Search ..... 96/27, 53, 2; 95/65, 95/71; 55/360; 239/690, 705

(56) References Cited

U.S. PATENT DOCUMENTS 3,785,118 A * 1/1974 Robertson ..... 95/71
3,960,505 A * 6/1976 Marks ..... 422/168
4,072,477 A * 2/1978 Hanson et al. ..... 95/71
4,106,697 A * 8/1978 Sickles et al. ..... 239/690.1
4,141,698 A * 2/1979 Kihlstedt et al. ..... 95/69
4,190,875 A * 2/1980 Smart et al. ..... 361/228
4,936,879 A * 6/1990 Priestley, Jr. ..... 96/2
5,518,525 A * 5/1996 Steed ..... 95/58
5,624,476 A * 4/1997 Eyraud ..... 95/65
5,843,210 A * 12/1998 Paranjpe et al. ..... 95/59
5,902,380 A * 5/1999 Tomimatsu et al. ..... 96/27
5,914,454 A * 6/1999 Imbaro et al. ..... 95/64
6,500,240 B1 * 12/2002 Tomimatsu et al. ..... 96/27

FOREIGN PATENT DOCUMENTS

EP 0808660 * 11/1997
GB 1455708 * 11/1976
JP 10-174899 * 6/1998

* cited by examiner

*Primary Examiner*—Richard L. Chiesa
(74) *Attorney, Agent, or Firm*—Oblon, Spivak, McClelland, Maier & Neustadt, P.C.

(57) ABSTRACT

A dust collector for collecting dust, in which the rarefaction of a dielectric at the rear part of electric field forming apparatus is prevented, whereby the collecting efficiency can be increased. The dust collector includes a charging device for charging a substance to be collected, such as dust and mist, contained in a gas; a sprayer device for spraying a dielectric on the substance to be collected which is charged by the charging device; an electric field forming device, having first and second electrodes and which form a direct current electric field and dielectrically polarize the dielectric sprayed by the spray device; and a dielectric collecting device for collecting the dielectric which has arrested the substance to be collected. The spray device includes grounding device and for electrically grounding the dielectric before being sprayed to let a charge of the dielectric escape.

17 Claims, 15 Drawing Sheets

DUST COLLECTOR

CROSS-REFERENCE TO RELATED APPLICATIONS

This application is a Divisional of U.S. patent application Ser. No. 09/635,430 filed Aug. 10, 2000, now U.S. Pat. No. 6,500,240, the entire contents of which are incorporated herein by reference in their entirety.

FIELD OF THE INVENTION AND RELATED ART STATEMENT

The present invention relates to a dust collector and method for collecting dust, which is used to remove dust, mist, and the like contained in a gas.

In order to efficiently collect fine dust (submicron particles), mist, and the like, the applicant has before proposed a dust collector in Japanese Patent Provisional Publication No. 10-174899 (No. 174899/1998).

This dust collector includes charging means for charging a substance to be collected such as dust and mist contained in a gas, spray means for spraying a dielectric on the substance to be collected charged by the charging means, electric field forming means for forming an electric field for dielectrically polarizing the dielectric sprayed from the spray means, and dielectric collecting means for collecting the dielectric which has arrested the substance to be collected.

The above-described dust collector has a high voltage applied electrode 100 and a ground electrode 200, shown in FIG. 24, as the electric field forming means, and allows an exhaust gas containing the substance to be collected such as dust and mist (in this example, $SO_3$ mist indicated by the black dots in the figure) 300 and a dielectric (in this example, water mist) 400 sprayed from the spray means to flow between the electrodes 100 and 200.

The substance to be collected 300 has been charged, for example, negatively in advance by the charging means. On the other hand, the dielectric 400 is dielectrically polarized by a direct current electric field formed between the electrodes 100 and 200. Therefore, the substance to be collected 300 is collected by the dielectric 400 by means of the Coulomb's force acting between the particles of dielectric 400.

When an alternating voltage is applied between the electrodes 100 and 200 as shown in FIG. 25, the polarization polarity of the dielectric 400 changes with time, and the charged substance to be collected moves in a zigzag form. Thus, the substance to be collected 300 is collected by the dielectric 400 by means of the Coulomb's force acting between the particles of dielectric 400.

According to this dust collector of the earlier application, submicron particles can be collected efficiently despite the compact configuration.

OBJECT AND SUMMARY OF THE INVENTION

In order to further increase the efficiency in collecting the substance to be collected 300, it is necessary for the dielectric 400 to exist enough up to the upper part (rear part) of the electrodes 100 and 200. In the conventional collector, however, the dielectric shows a tendency to rarefy at the upper part (rear part) of the electrodes 100 and 200.

The inventors found that the aforementioned tendency is ascribed to the charging of the dielectric sprayed from the spray means.

Specifically, the particles of dielectric sprayed from the spray means are charged positively or negatively because the particles of dielectric exchange charges at the boundary of a pipe through which the dielectric itself flows. Therefore, the dielectric 400 having been charged positively or negatively is sprayed from the spray means, which is a cause of bringing about the aforementioned tendency as described below.

In FIG. 26 corresponding to FIG. 24, the circle mark applied to the side of the particle of dielectric 400 indicates the charging state of the particle of dielectric 400. If the charged dielectric 400 is supplied between the electrodes 100 and 200, the positively charged dielectric 400 is attracted to the electrode 100, and the negatively charged dielectric 400 is attracted to the electrode 200 by means of the Coulomb's force. Therefore, most of the dielectric 400 is collected by the electrodes 100 and 200 before it arrives at the upper part (rear part) of the electrodes 100 and 200.

FIG. 27 shows a case where an alternating electric field is applied to between the electrodes 100 and 200. In this case, the charged dielectric 400 goes while being swayed to right and left with the change cycles of alternating electric field. At this time, the particles of dielectric 400 having a positive and negative charge are attracted to one another and aggregate, so that the distribution concentration of the dielectric 400 decreases toward the upper part of the electrodes 100 and 200. That is, even if an alternating electric field is applied to between the electrodes 100 and 200, the dielectric 400 rarefies at the upper part of the electrodes 100 and 200.

The present invention has been made in view of the above situation, and accordingly an object thereof is to provide a dust collector and method for collecting dust in which the rarefaction of dielectric at the rear part of electric field forming means is prevented, whereby the collecting efficiency can be increased.

To achieve the above object, the present invention provides a dust collector, comprising charging means for charging a substance to be collected, such as dust and mist, contained in a gas; spray means for spraying a dielectric on the substance to be collected charged by the charging means; electric field forming means, having first and second electrodes for forming a direct current electric field, for dielectrically polarizing the dielectric sprayed by the spray means by means of the direct current electric field; dielectric collecting means for collecting the dielectric which has arrested the substance to be collected; and grounding means, provided in the spray means, for electrically grounding the dielectric before being sprayed, wherein a charge of the dielectric is caused to escape by the grounding means so that the dielectric is made electrically neutral.

According to the present invention, since the electrically neutral dielectric is sprayed from the spray means, the arrest of the sprayed dielectric by the electrode of the electric field forming means is restrained. Therefore, a shortage of dielectric in the rear zone of an electric field forming section is prevented, so that the efficiency in collecting the substance to be collected is increased.

A metallic net is used as the grounding means, and the net can be disposed in a flow path of the dielectric in the spray means so as to traverse the flow path. With the use of the metallic net as de-electrifying means, a satisfactory de-electrifying effect can be achieved without obstructing the flow of the dielectric.

Also, the present invention provides a dust collector, comprising charging means for charging a substance to be collected, such as dust and mist, contained in a gas; spray means for spraying a dielectric on the substance to be collected charged by the charging means; electric field forming means, having first and second electrodes for forming a direct current electric field, for dielectrically polarizing the dielectric sprayed by the spray means by means of the direct current electric field; and dielectric collecting means for collecting the dielectric which has arrested the substance to be collected, wherein a plurality of corona discharge sections arranged in the flow direction of the gas at given intervals are formed on the opposed surfaces of the first and second electrodes to generate band-shaped uniform corona discharge perpendicular to the gas flow, and the dielectric is provided with a charge of reverse polarity alternately by the corona discharge.

According to the present invention, the dielectric goes in a zigzag form to the rear zone of the electric field forming means under the action of the charge developed by discharge of the corona discharge section, so that the substance to be collected can be collected very efficiently.

The arrangement interval between the corona discharge sections on the first electrode and the arrangement interval between the corona discharge sections on the second electrode are preferably set so as to be equal to each other. Also, both of the corona discharge sections are preferably provided so as to have an arrangement phase difference of ½ of the arrangement interval in the flow direction of the gas. According to this configuration, corona discharge on the electrodes of the electric field forming section does not oppose, so that the occurrence of spark discharge can be restrained.

The rear parts of the first and second electrodes can be extended, and a plurality of the corona discharge sections can be formed in the flow direction of the gas on one of these extensions only. According to this configuration, the dielectric can be collected at the extension of the electrode of the electric field forming section, so that a demister can be omitted.

Further, the present invention provides a dust collector, comprising charging means for charging a substance to be collected, such as dust and mist, contained in a gas; spray means for spraying a dielectric on the substance to be collected charged by the charging means; electric field forming means, having first and second electrodes for forming a direct current electric field, for dielectrically polarizing the dielectric sprayed by the spray means by means of the direct current electric field; and dielectric collecting means for collecting the dielectric which has arrested the substance to be collected, wherein the distribution of the dielectric sprayed by the spray means is set so that the distribution of the dielectric at the rear part of the first and second electrodes is uniformed.

According to the present invention, the dielectric can be caused to exist uniformly in the rear zone of the electric field forming section, so that the collecting efficiency is increased.

Sill further, the present invention provides a dust collector, comprising charging means for charging a substance to be collected, such as dust and mist, contained in a gas; spray means for spraying a dielectric on the substance to be collected charged by the charging means; electric field forming means, having first and second electrodes for forming a direct current electric field, for dielectrically polarizing the dielectric sprayed by the spray means by means of the direct current electric field; and dielectric collecting means for collecting the dielectric which has arrested the substance to be collected, wherein the spray means is provided with charge providing means for providing the dielectric before being sprayed with a charge having a reverse polarity of the charging polarity of the substance to be collected.

According to the present invention, a repelling force acts between the particles of sprayed dielectric, so that the aggregation of the particles of dielectric in the electric field forming section is prevented, thereby increasing the collecting efficiency.

The charge providing means can be configured so as to supply ionized air to the dielectric before being sprayed. According to this configuration, the dielectric is charged via the ionized air.

Also, the charge providing means can be configured so that magnetism in the direction perpendicular to the flow direction of the dielectric is applied to the dielectric before being sprayed. According to this configuration, the dielectric is charged by the action of the magnetism.

In the dust collectors described above, a plurality of stages of the pair of the spray means and the electric field forming means can be disposed. According to this configuration, the substance to be collected is collected in a dust collecting section of each stage, so that a very high dust collecting efficiency can be obtained.

In this configuration, fresh water is sprayed from spray means of at least the most downstream stage of the plurality of spray means, and circulating water is sprayed from spray means excluding the spray means which sprays freshwater. According to this configuration, since fresh water is sprayed from spray means of at least the most downstream stage, the collecting efficiency is further increased. Therefore, this configuration is especially advantageous in preventing the outflow of harmful substances.

The spray means of the most downstream stage can be provided with a nozzle for atomizing the fresh water to an average diameter not larger than 50 $\mu$m. If such a nozzle is provided, the nozzle is not clogged, thereby maintaining a high dust collecting efficiency, and the quantity of fresh water used can be decreased.

The dust collectors described above can be configured so as to further comprise a dielectric circulating system for supplying the dielectric from a dielectric storage tank to the spray means and for returning the sprayed dielectric from the spray means to the storage tank; dielectric supply means for supplying a fresh dielectric to the dielectric storage tank; dielectric discharge means for discharging the dielectric in the dielectric storage tank; absorbent charging means for charging an absorbent in the dielectric storage tank, the absorbent being used to absorb a reaction product produced by a substance in the gas; and control means for controlling the quantity of dielectric supplied by the dielectric supply means and the quantity of dielectric discharged by the dielectric discharge means so that the concentration of the reaction product exhibits a value within a given range and for controlling the quantity of absorbent charged by the absorbent charging means so that the pH value of the dielectric exhibits a value within a given range.

According to this configuration, the deterioration in dielectric can be prevented, and also harmful gas can be absorbed and removed positively.

A method for collecting dust in accordance with the present invention comprises a first step of charging a substance to be collected, such as dust and mist, contained in a gas; a second step of causing the gas having undergone the first step to flow from the downside to the upside; a third step of spraying a dielectric on the substance to be collected contained in the gas flowing from the downside to the upside; a fourth step of dielectrically polarizing the sprayed dielectric and of causing the dielectric to arrest the substance to be collected by means of the Coulomb's force created by the polarization; and a fifth step of collecting the dielectric which has arrested the substance to be arrested.

According to the present invention, the gas in which the substance to be collected has been charged is moved from the downside to the upside, so that a nonuniform distribution of the substance to be collected caused by the action of the gravity is not formed. Therefore, the substance to be collected is distributed uniformly, and is collected efficiently.

DETAILED DESCRIPTION OF PREFERRED EMBODIMENTS

Figure 1:
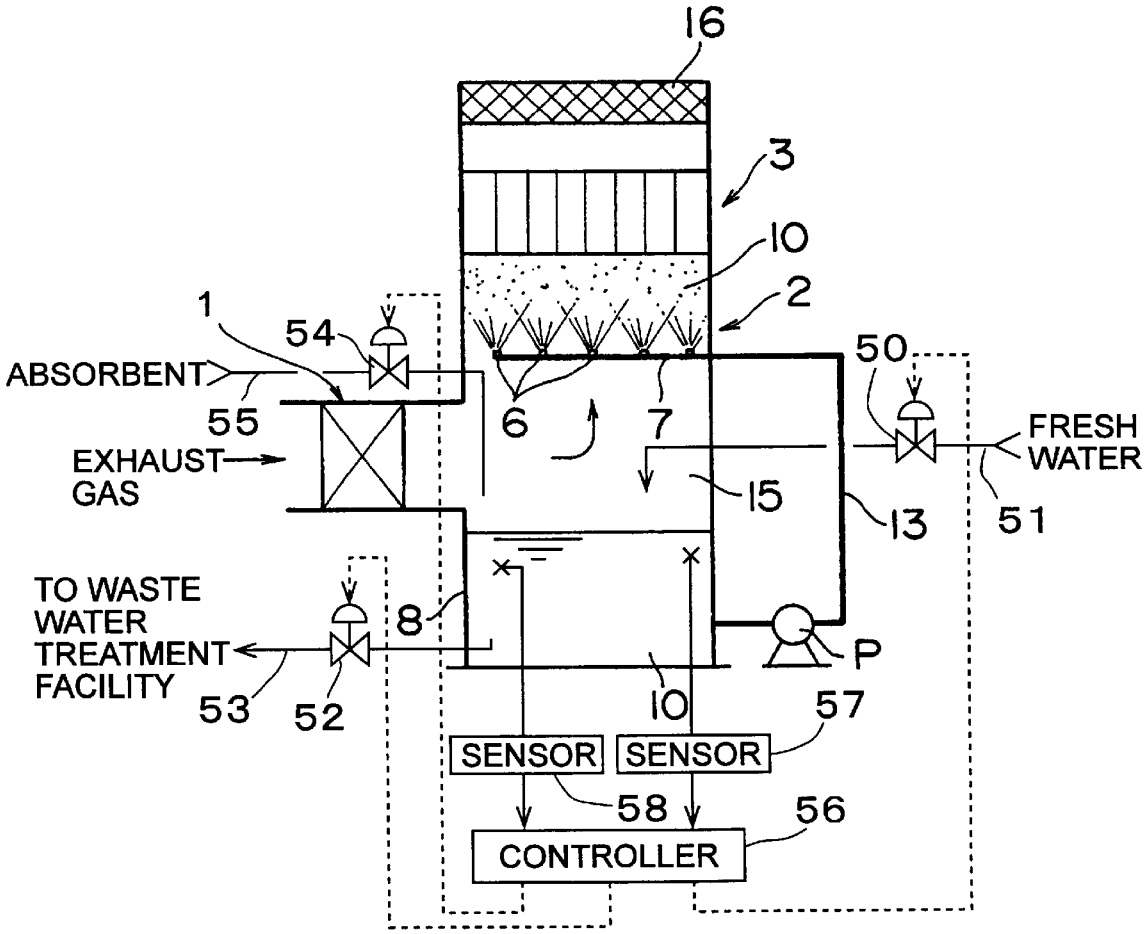
FIG. 1 is a schematic longitudinal sectional view showing a general construction of a dust collector in accordance with the present invention.

FIG. 1 is a schematic longitudinal sectional view showing a general construction of a dust collector to which the present invention is applied. This dust collector has a preliminary charging section 1, a spray section 2, and a dust collecting section 3.

Figure 2:
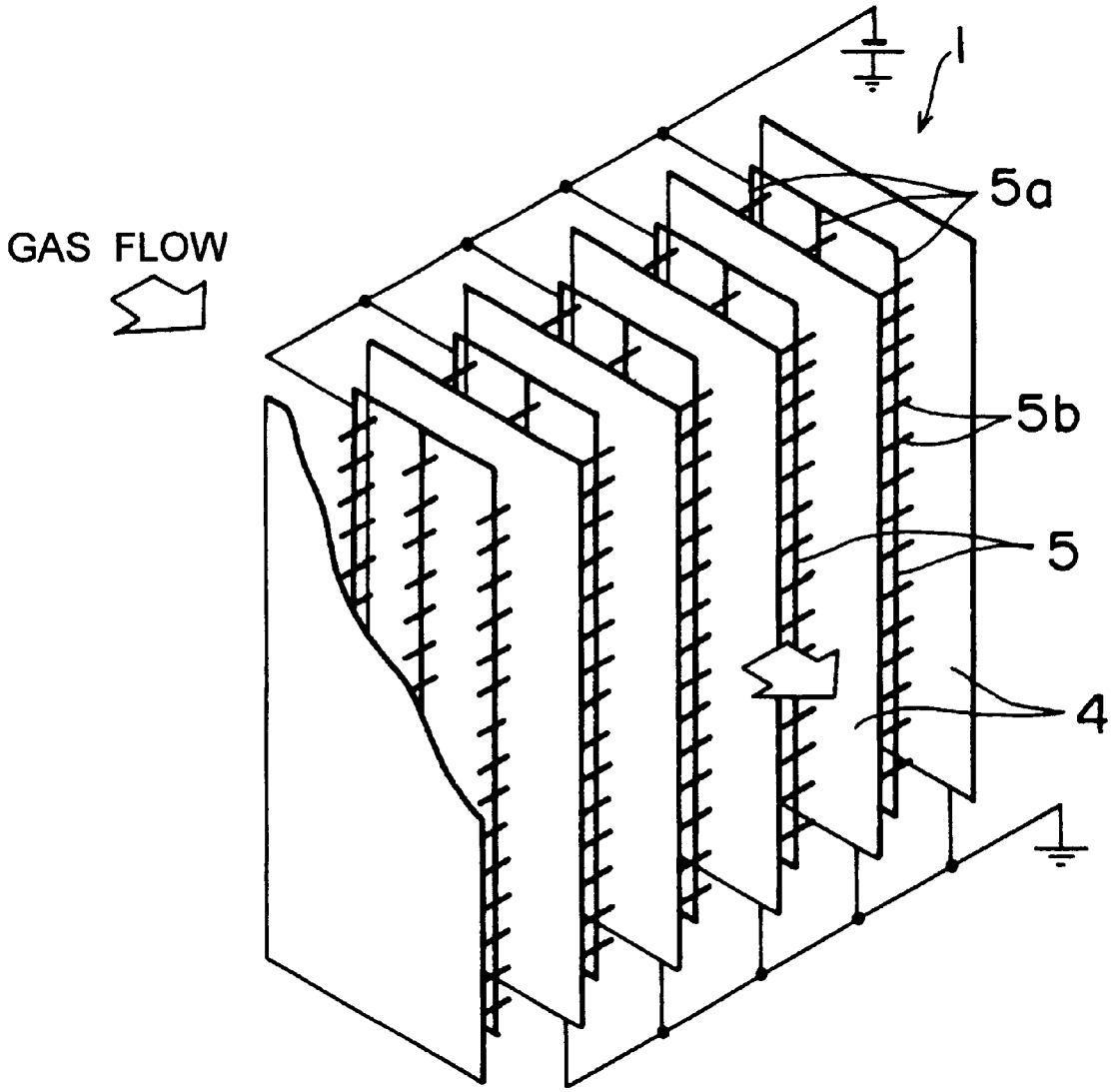
FIG. 2 is a schematic perspective view showing a construction of a preliminary charging section.

The preliminary charging section 1 includes, as shown in FIG. 2, a plurality of ground electrodes (positive electrodes) 4 arranged in parallel and discharge electrodes (negative electrodes) 5 disposed between the ground electrodes 4. The discharge electrode 5 is configured so that a plurality of (three, in this example) conductive rods 5*a* are disposed vertically in a plane parallel with the ground electrode 4, and a large number of spine-like portions 5*b* are arranged in the vertical direction of the rod 5*a* at appropriate intervals.

Figure 3:
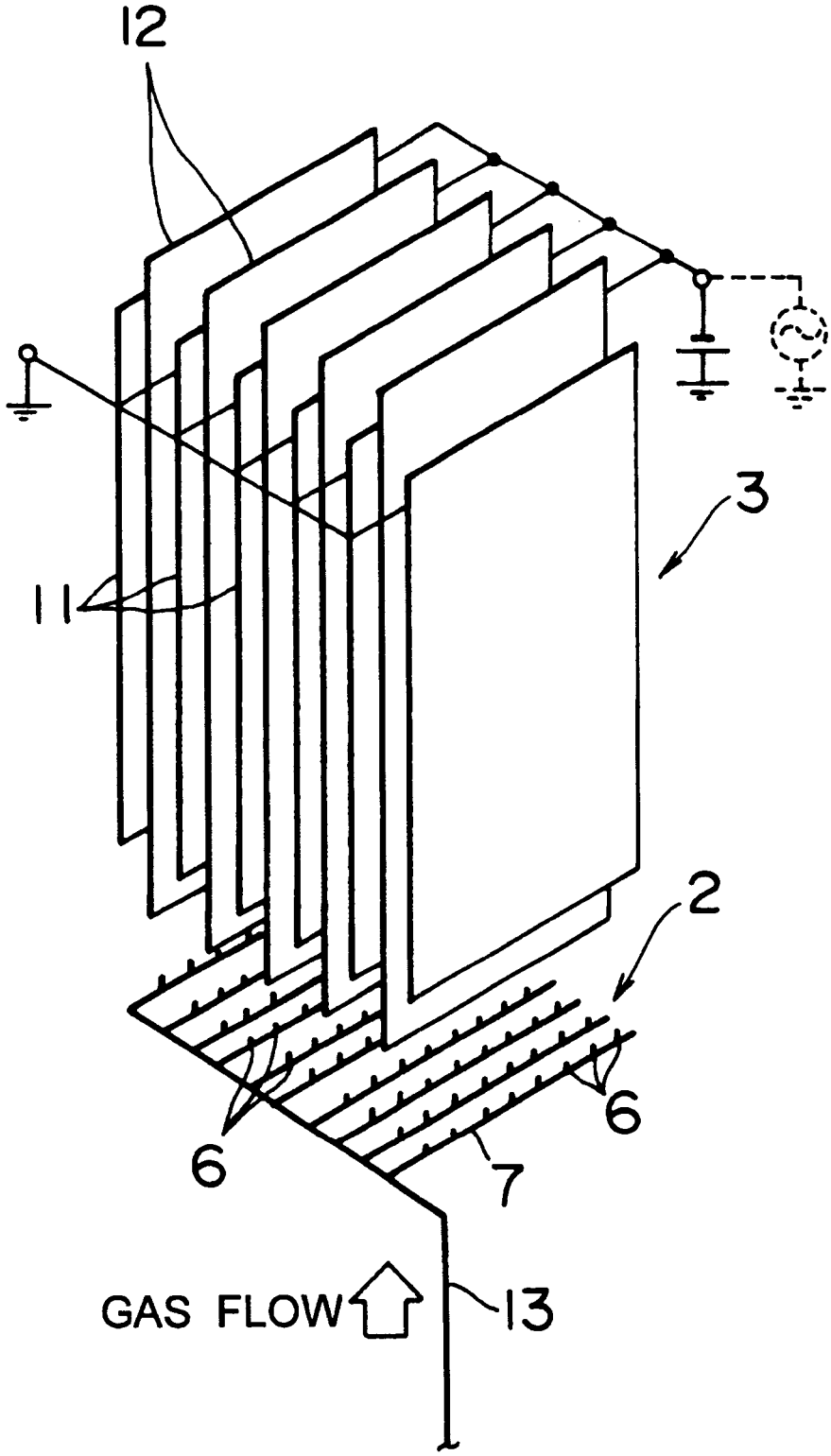
FIG. 3 is a schematic perspective view showing a construction of a dust collecting section.

The spray section 2 is, as shown in FIG. 3, provided with a large number of nozzles 6 for spraying a dielectric, which are arranged under the dust collecting section 3. The nozzles 6 are formed on a plurality of pipes 7 arranged horizontally at appropriate intervals.

As shown in FIG. 1, the pipe 7 is connected to a dielectric storage tank 8 via a pipe 13. Therefore, if a dielectric (water in this example) 10 in the storage tank 8 is drawn up by a pump P interposed in the pipe 13, the mist-like dielectric 10 is sprayed from the nozzles 6.

The dust collecting section 3 includes, as shown in FIG. 3, a plurality of ground electrodes 11 arranged in parallel and high voltage applied electrodes 12 interposed between the ground electrodes 11.

In the dust collector constructed as described above, as indicated by the arrow mark in FIG. 1, an exhaust gas from which dust is to be removed (for example, an exhaust gas generated when coal, heavy oil, or the like is burned) is introduced into the preliminary charging section 1. The exhaust gas passes between the ground electrode 4 and the discharge electrode 5 shown in FIG. 2. At this time, a substance to be collected such as dust, mist, and the like contained in the exhaust gas is provided with a charge by corona discharge occurring between the electrodes 4 and 5. In this example, by the provision of the charge, the substance to be collected is charged negatively.

The exhaust gas having passed through the preliminary charging section 1 flows into a gas absorbing zone 15 shown in FIG. 1, and then, after flowing upward, it is introduced into the dust collecting section 3 together with the dielectric 10 sprayed from the spray section 2.

The sprayed dielectric 10 is dielectrically polarized by a direct current electric field or an alternating electric field acting between the electrodes 11 and 12 (see FIG. 3) of the dust collecting section 3. Therefore, the negatively charged substance to be collected sticks to the dielectric 10 by means of the Coulomb's force acting between the particles of dielectric 10.

The dielectric to which the substance to be collected has stuck is recovered in a dielectric collecting section 16 consisting of a demister or the like. Therefore, a clean gas from which the substance to be collected has been removed is discharged from the dielectric collecting section 16.

Since this dust collector is applied to the treatment of a harmful gas, the sprayed dielectric 10 absorbs some of the harmful gas. Specifically, for example, in the case where the dust-containing gas contains a harmful gas such as SOx, the dielectric 10 absorbs the SOx during the time when the dielectric 10 is used by being circulated.

If the dielectric 10 absorbs a harmful gas in this manner, the pH value of the dielectric 10 decreases, so that a problem of corrosion etc. arises. In this dust collector, therefore, in order to solve the above problem, there are provided a fresh water supply pipe 51 in which a valve 50 is interposed, a discharge pipe 53 in which a valve 52 is interposed, an absorbent supply pipe 55 in which a valve 54 is interposed, and a controller 56 or the like for controlling the valves 50, 52 and 54.

Specifically, the dielectric 10 in the storage tank 8 contains a reaction product according to the absorption amount (treatment amount) of SOx or the like contained in the dust-containing gas. Therefore, the controller 56 controls, based on the output of a concentration sensor 57 for detecting the in-liquid concentration of the reaction product, the valves 50 and 52 so that the in-liquid concentration exhibits a value within a given range. That is to say, the controller 56 regulates the quantity of fresh water poured into the tank 8 and the quantity of dielectric 10 discharged from the tank 8.

Also, the controller 56 controls, based on the output of a pH sensor 58 for detecting the pH concentration of the dielectric 10 in the tank 8, the valve 54 so that the pH concentration exhibits a value within a given range. That is to say, the controller 56 regulates the quantity of absorbent (for example, NaOH and Mg) charged into the tank 8 to absorb the reaction product.

If the in-liquid concentration of the reaction product and the pH value of the dielectric 10 are controlled as described above, not only the corrosion or the like can be prevented, but also the harmful gas can be removed positively by utilizing the harmful gas absorbing function of the dielectric 10.

Although the in-liquid concentration of the reaction product is controlled based on the output of the concentration sensor 57 in the above description, the concentration control can be carried out without the use of the concentration sensor 57.

Specifically, since the average degree of increase in the in-liquid concentration is known in advance by an experiment etc., the quantity of fresh dielectric (freshwater) poured into the tank 8 and the quantity of dielectric discharged from the tank 8, which correspond to the degree of increase, are determined in advance, and the valves 50 and 52 are controlled so that the poured quantity and discharged quantity are attained. Thereby, the in-liquid concentration of the reaction product can be made within a given range.

First, embodiments in which the direct current electric field is formed between the electrodes 11 and 12 shown in FIG. 3 will be explained.

(Embodiment 1)

Figure 26:
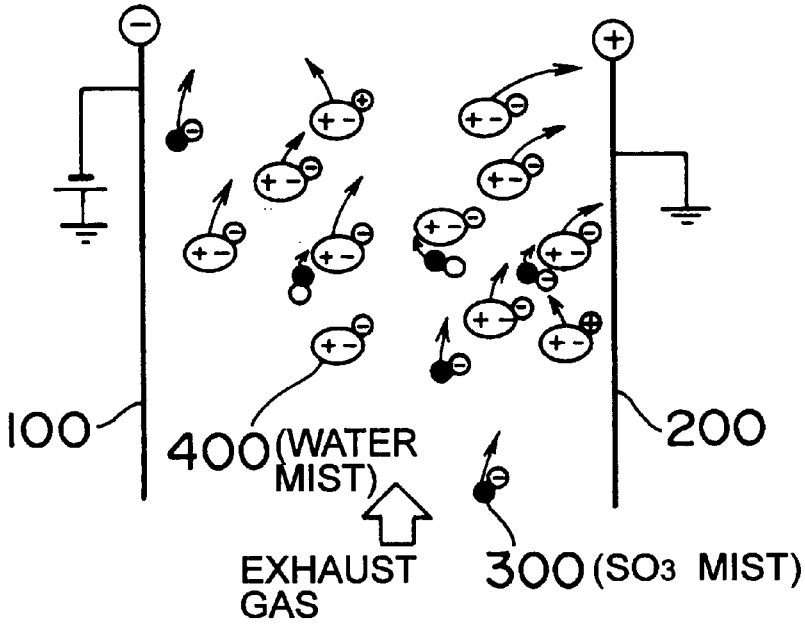
FIG.26 (RELATED ART)
FIG. 26 is an explanatory view typically showing behavior of the particles of dielectric in the direct current electric field in a conventional dust collector.

As described above, the dielectric 10 sprayed from the spray section 2 has been charged positively or negatively. When the direct current electric field is formed between the electrodes 11 and 12 of the dust collecting section 3, the charging of the dielectric 10 decreases the efficiency in collecting the substance to be collected for the aforementioned reason (sticking of the dielectric to the electrode) explained with reference to FIG. 26.

Figure 4:
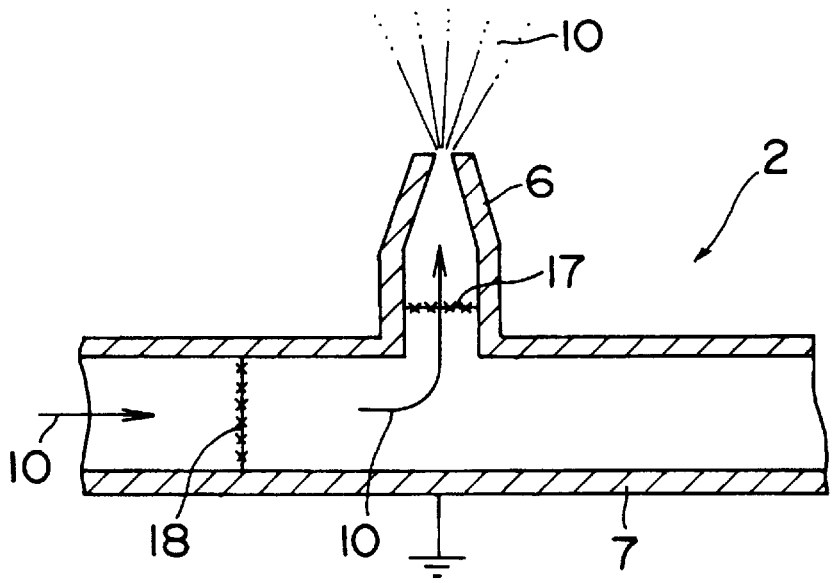
FIG. 4 is a sectional view showing a construction of a spray section.

Thereupon, in the dust collector of embodiment 1, the spray section is formed as shown in FIG. 4. This spray section is configured so that an earth net 17 is disposed in the nozzle 6, and an earth net 18 is disposed at a slightly upstream position from the position where the nozzle 6 is disposed in the pipe 7.

The earth nets 17 and 18, which are made of a metal, are provided so as to traverse the flow path of the dielectric 10. The pipe 7 and the nozzle 6 are grounded, so that the earth nets 17 and 18 fitted to these elements are also grounded.

The charged dielectric 10 flowing through the pipe 7 is de-electrified during the time when it passes through the earth nets 17 and 18. As a result, the dielectric 10 that has been de-electrified, that is, that is electrically neutral, is sprayed from the nozzle 6.

The de-electrified dielectric 10 having been sprayed from the nozzle 6 is not subjected to the Coulomb's force created by the direct current electric field between the electrodes 11 and 12 when it is introduced to between the electrodes 11 and 12 shown in FIG. 3. Therefore, most of the dielectric 10 moves toward the upper part (rear part) of the electrodes 11 and 12 without being arrested by the electrodes 11 and 12. As a result, even at the upper part of the electrodes 11 and 12, the substance to be collected is efficiently collected by the dielectric 10.

With the use of the earth nets 17 and 18 as de-electrifying means, a satisfactory de-electrifying effect can be achieved without obstructing the flow of the dielectric 10.

Figure 5:
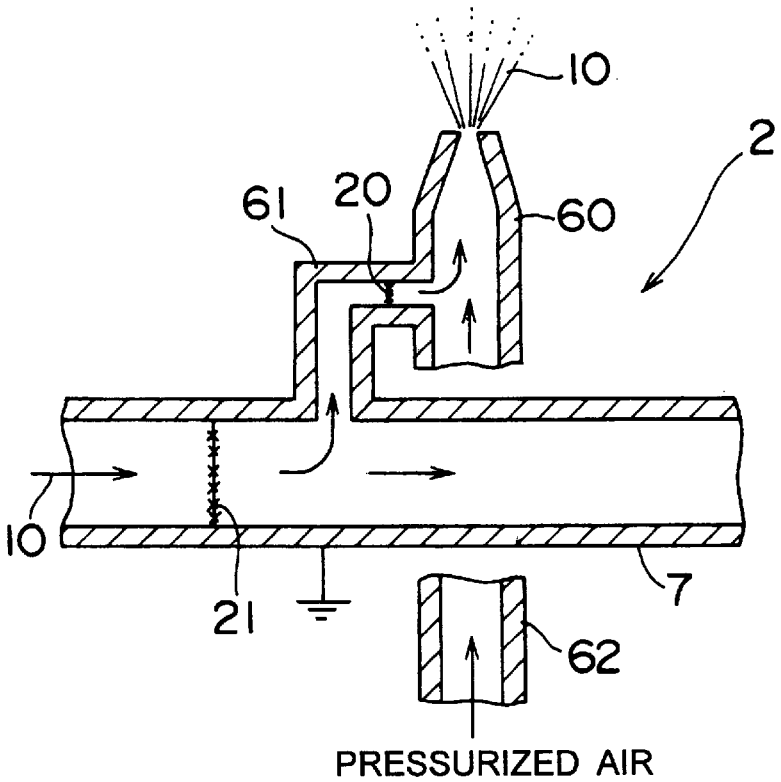
FIG. 5 is a sectional view showing another construction of the spray section.

In the spray section 2, a two fluid nozzle as shown in FIG. 5 can be used. For this two fluid nozzle 60, the dielectric 10 is introduced from the side of the nozzle 60 via an introduction pipe 61, and at the same time, a pressurized air is introduced via an air supply pipe 62 continuous with the lower part of the nozzle 60, so that the dielectric 10 can be sprayed from the tip end of the nozzle 60.

When this two fluid nozzle 60 is used, an earth net 20 is disposed at the outlet of the introduction pipe 61, and an earth net 21 is disposed at a slightly upstream position from the position where the nozzle 60 is disposed in the pipe 7. Thereby, the de-electrified dielectric 10 is sprayed from the nozzle 60 as in the case of the nozzle 6 shown in FIG. 4.

Figure 6:
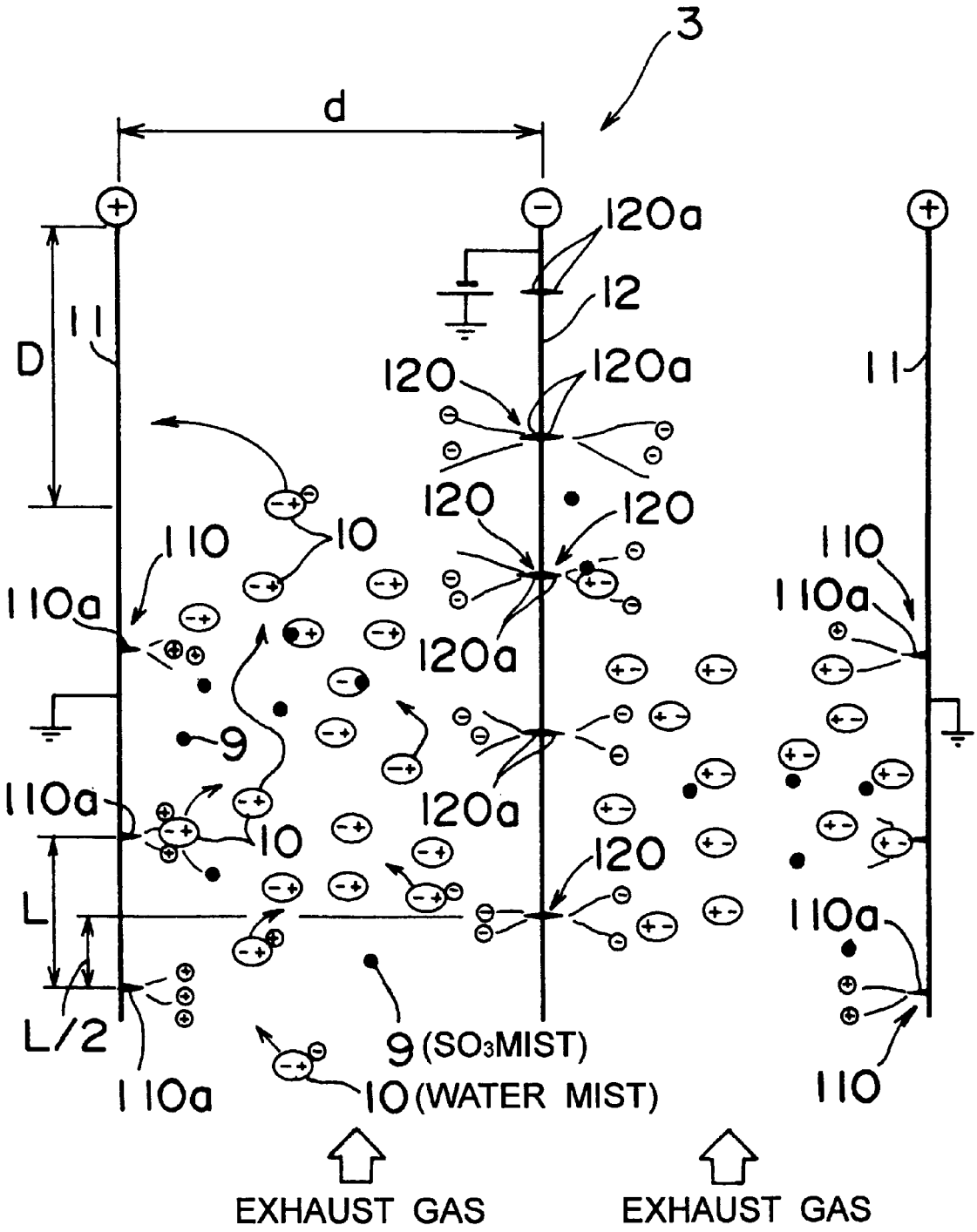
FIG. 6 is a schematic perspective view showing another construction of the dust collecting section.

FIG. 6 shows an embodiment in which a plurality of corona discharge sections 110 and 120 arranged in the flow direction of the gas are formed on the opposed surfaces of the electrodes 11 and 12 of the dust collecting section 3, respectively. In this embodiment as well, the direct current electric field is formed between the electrodes 11 and 12.

Figure 7:
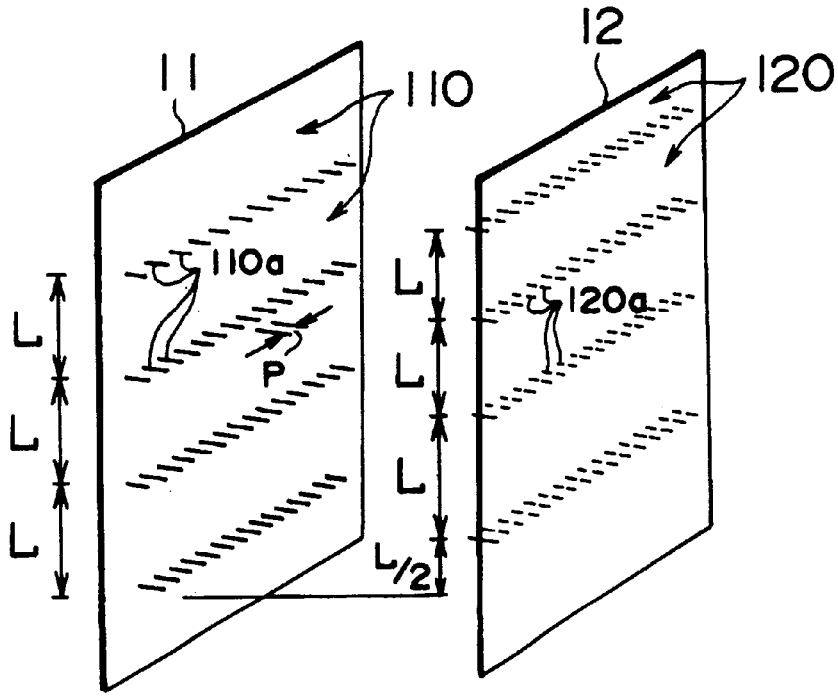
FIG. 7 is a schematic perspective view showing a construction of a corona discharge section.

As shown in FIG. 7, the corona discharge sections 110 and 120 are located at intervals of L, and have an arrangement phase difference of L/2 with respect to each other in the flow direction of the exhaust gas.

Figure 8:
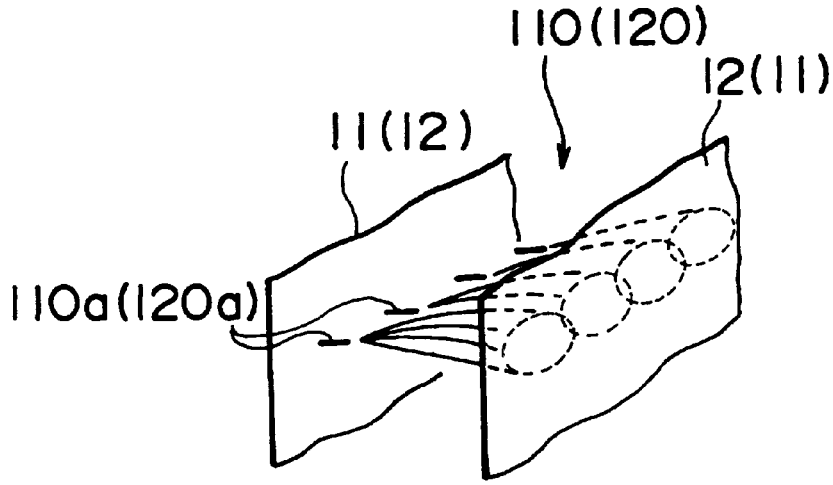
FIG. 8 is a partial perspective view showing a mode of discharge of the corona discharge section.

The corona discharge sections 110 and 120 each have a configuration in which small protrusions 110*a* and 120*a* are disposed closely with a pitch P in the direction perpendicular to the gas flow. Therefore, as shown in FIG. 8, a band-shaped corona current can be supplied from the corona discharge section 110 (120) to the opposed electrode 12 (11).

In FIG. 6, when its initial charging polarity is negative, the dielectric 10 going between the electrodes 11 and 12 is transferred to the electrode 11 by the Coulomb's force created by the direct current electric field between the electrodes 11 and 12.

The corona discharge sections 110 and 120 release the positive and negative charges, respectively, by corona discharge between the electrodes. Therefore, the dielectric 10 transferred to the electrode 11 is charged positively by the charge released from the corona discharge section 110, with the result that the dielectric 10 is transferred to the electrode 12. The dielectric 10 transferred to the electrode 12 is charged negatively by the charge released from the corona discharge section 120, so that the dielectric 10 is transferred again to the electrode 12. That is to say, the dielectric 10 transfers while being provided with a charge of reverse polarity alternately.

Thus, the dielectric 10 (water mist in this example) goes upward between the electrodes 11 and 12 while transferring in a zigzag form, and is dielectrically polarized by the electric field acting between the electrodes 11 and 12. On the other hand, the particles of substance to be collected ($SO_3$ mist in this example) 9 indicated by the black dots scarcely move in the direction such as to traverse the gas flow (right and left direction in FIG. 6). As a result, the dielectric 10 goes in a zigzag form while collecting the substance to be collected 9 by means of the Coulomb's force acting between the particles of dielectric 10.

The particle size of the dielectric 10 is appreciably larger than that of the substance to be collected 9, so that the quantity of charge given to a unit weight of the dielectric 10 per unit time is considerably larger than that of the substance to be collected 9. The above-described operation such that the dielectric 10 collects the substance to be collected 9 while going in a zigzag form is attained by a difference in the quantity of charge given to a unit weight per unit time.

According to this embodiment 2 in which the charges developed by the discharge of the corona discharge sections 110 and 120 are utilized, the dielectric 10 can be caused to exist up to the upper part of the electrodes 11 and 12, so that the efficiency in collecting the substance to be collected 9 is increased.

If the arrangement interval L between the corona discharge sections 110 and 120 is set so as to be smaller than the given interval, the discharge sections 110 and 120 are opposed to each other and a locally high electric field is formed in a spot form, so that there is a fear of the occurrence of spark discharge. Therefore, the arrangement interval L is preferably set so as to be $L \geqq d$ (d denotes a distance between the electrodes 11 and 12).

In this embodiment 2, the upper ends (rear end) of the electrodes 11 and 12 are extended by an appropriate length D, and the corona discharge sections 120 are formed at the extension of the electrode 12 only. In this configuration, the dielectric 10 that has arrested the substance to be collected 9 and has arrived at the extensions of the electrodes 11 and 12 is finally attracted and collected by the electrode 11, that is, the extension of the electrode 11 has a function of collecting the dielectric 10. Therefore, the demister 16 shown in FIG. 1 can be omitted.

The corona discharge sections 110 may be formed at the extension of the electrode 11 only. In this case, the dielectric 10 that has arrested the substance to be collected 9 is finally attracted and collected by the electrode 12.

Figure 9:
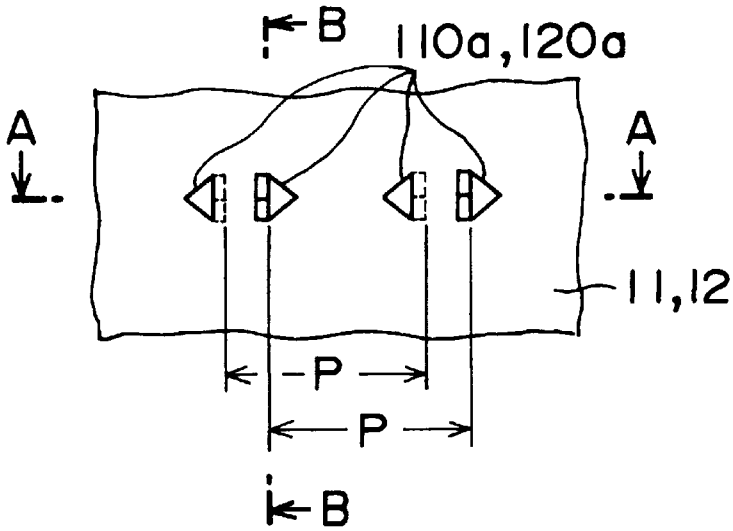
FIG. 9 is a plan view showing a construction of small protrusions constituting the corona discharge section.
Figure 10:
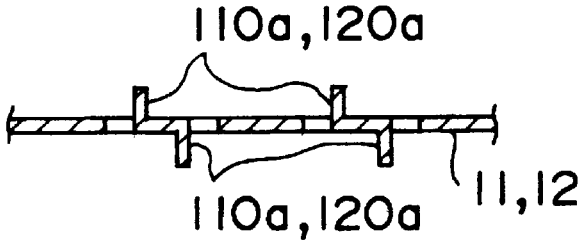
FIG. 10 is a sectional view taken along the line A—A of FIG. 9.
Figure 11:
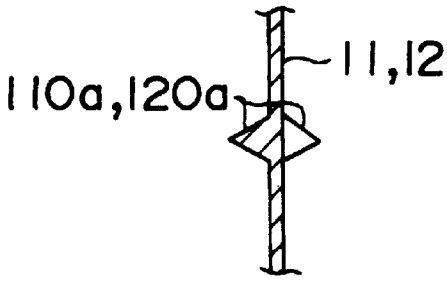
FIG. 11 is a sectional view taken along the line B—B of FIG. 9.

FIG. 9 is a plan view showing an example of the small protrusions 110*a*, 120*a* constituting the corona discharge section 110, 120. FIGS. 10 and 11 are sectional views taken along the lines A—A and B—B of FIG. 9, respectively. The small protrusion 110*a*, 120*a* shown in these figures is formed into a triangular shape by cutting and raising a metal plate forming the electrode 11, 12. These protrusions 110*a*, 120*a*, having a sharp tip end, are advantageous in concentrating the electric field.

Figure 12:
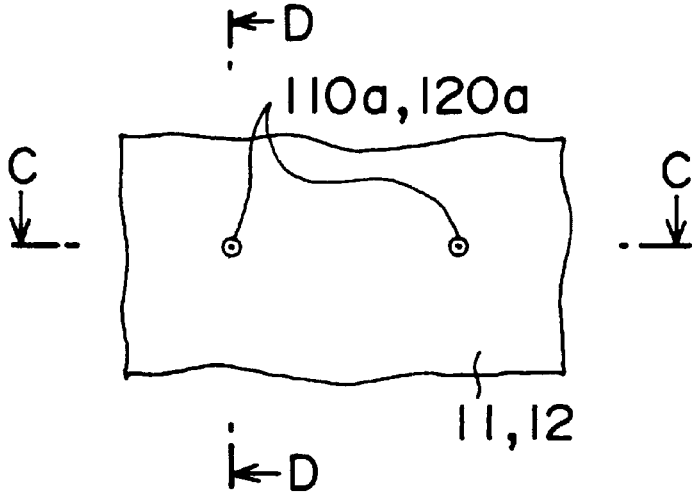
FIG. 12 is a plan view showing another construction of the small protrusions constituting the corona discharge section.
Figure 13:
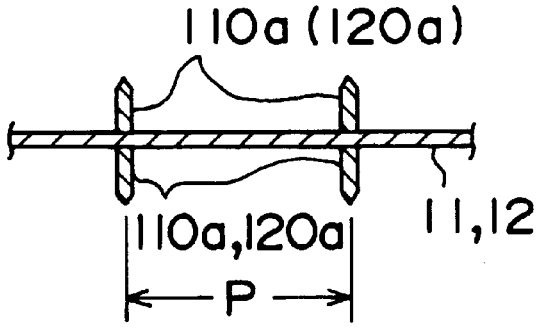
FIG. 13 is a sectional view taken along the line C—C of FIG. 12.
Figure 14:
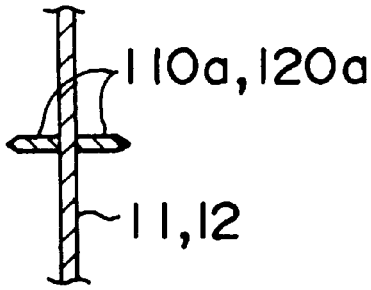
FIG. 14 is a sectional view taken along the line D—D of FIG. 12.

FIG. 12 is a plan view showing another example of the small protrusions 110*a*, 120*a*. FIGS. 13 and 14 are sectional views taken along the lines C—C and D—D of FIG. 12, respectively. This small protrusion 110*a*, 120*a* is formed by welding a spine-like stud to the electrode 11, 12.

Figure 15:
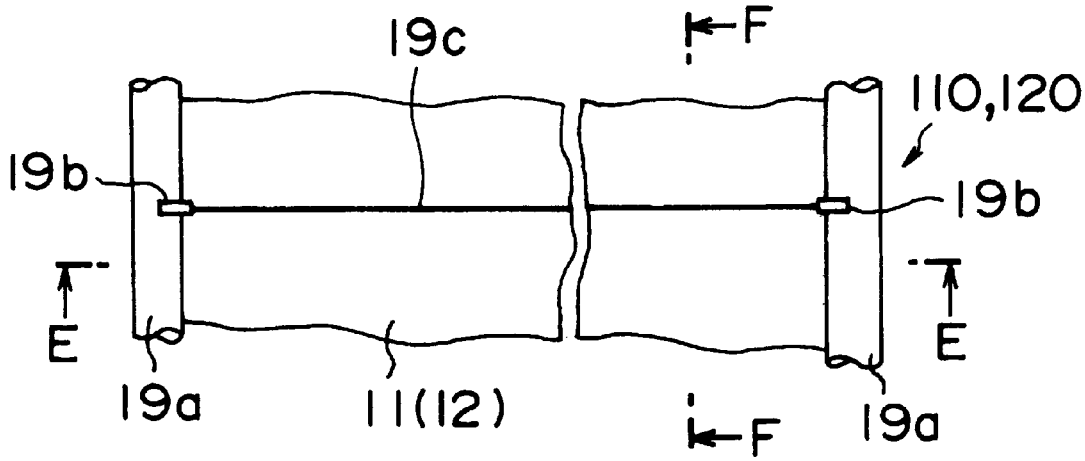
FIG. 15 is a plan view showing another construction of the corona discharge section.
Figure 16:
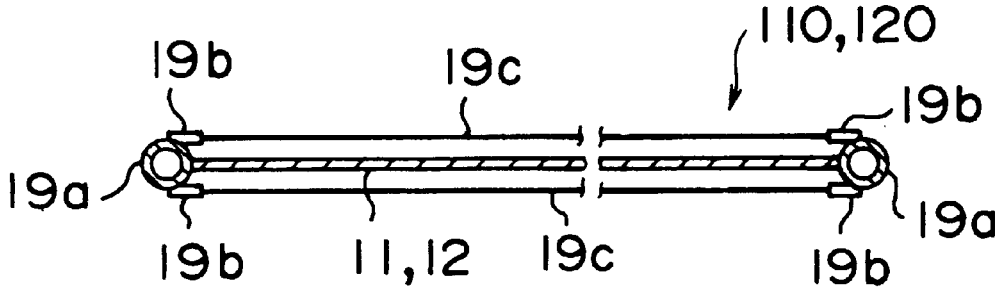
FIG. 16 is a sectional view taken along the line E—E of FIG. 15.
Figure 17:
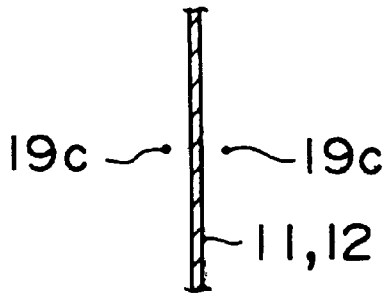
FIG. 17 is a sectional view taken along the line F—F of FIG. 15.

FIG. 15 is a plan view showing another construction of the corona discharge section 110, 120. FIGS. 16 and 17 are sectional views taken along the lines E—E and F—F of FIG. 15, respectively. The corona discharge section 110, 120 is made up of conductive electrode reinforcing pipes 19*a* fixed to both sides of the electrode 11, 12 and small-diameter conductive wires 19*c* stretched between the electrode reinforcing pipes 19*a* via conductive wire mounting pieces 19*b*.

According to this corona discharge section 110, 120, a band-shaped corona current can be supplied from the wire 19*c* of the discharge section 110, 120 to the opposed electrode 12, 11.

Figure 18:
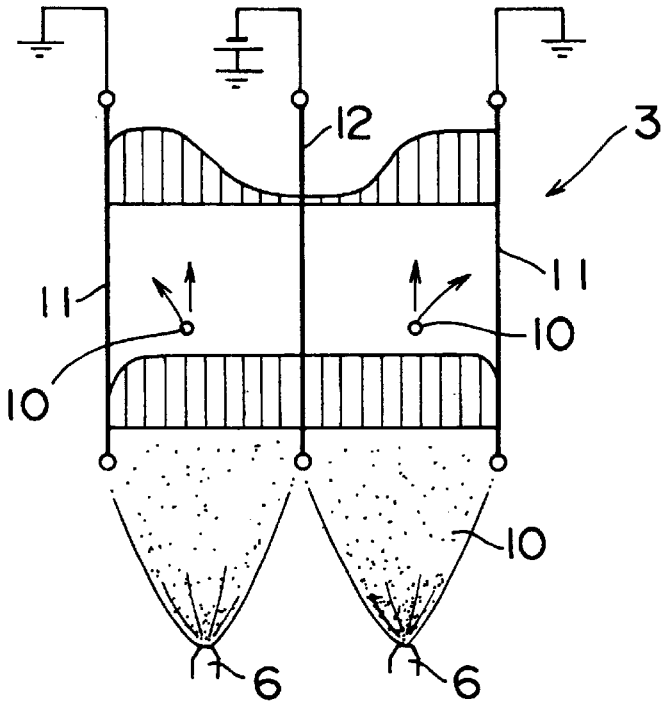
FIG. 18 is a schematic sectional view showing a general distribution mode of dielectric in the dust collecting section.

FIG. 18 shows a distribution mode of dielectric 10 in the dust collecting section 3 in the case where the direct current electric field is formed between the electrodes 11 and 12 and the dielectric 10 sprayed from the spray section 2 is charged negatively. As shown in FIG. 18, the distribution of the dielectric 10 is uniform in the lower zone of the electrodes 11 and 12, but much of the dielectric 10 is distributed on the side of the electrode 11 in the upper zone thereof. The reason for this is that the negatively charged dielectric 10 is attracted to the positive electrode 11 as it transfers to the upper part of the electrodes 11 and 12.

If a nonuniform distribution of the dielectric 10 is formed in the upper zone of the electrodes 11 and 12 as described above, the efficiency in collecting the substance to be collected decreases in the upper zone.

(Embodiment 3)

Figure 19:
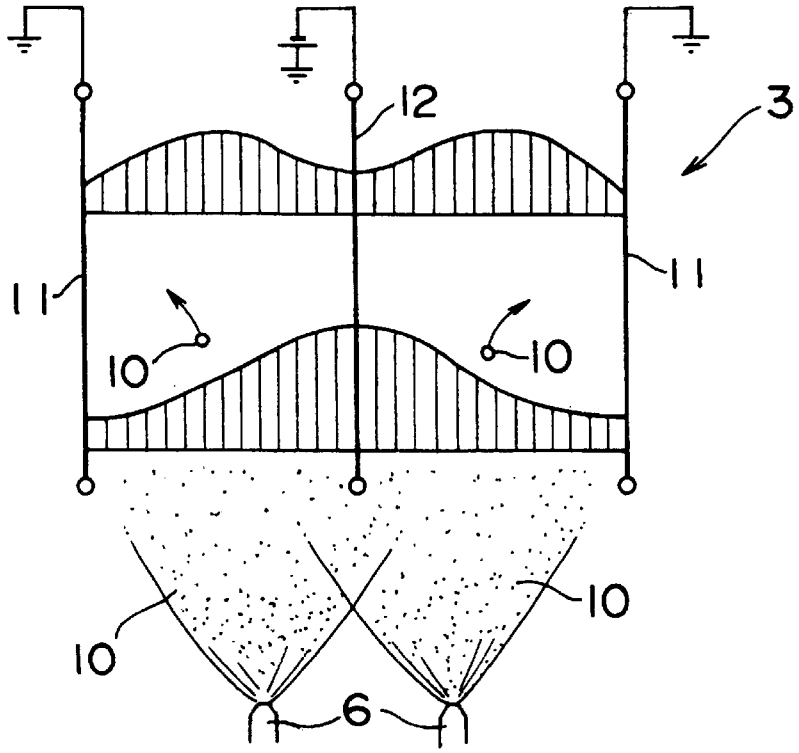
FIG. 19 is a schematic sectional view typically showing a spray mode of dielectric in the dust collector in accordance with the present invention.

FIG. 19 shows another embodiment of the present invention in which the above problem is solved. In this embodiment, the distance between the electrodes 11 and 12 is increased, and the right and left nozzles 6 of the spray section are substantially shifted from the middle position between the electrodes 11 and 12 to a position close to the electrode 12.

According to this configuration, since the dielectric 10 sprayed from both of the right and left nozzles 6 is supplied to the periphery of the electrode 12, much of dielectric 10 is distributed on the side of the electrode 12.

The dielectric 10, which has been charged negatively, transfers upward in the dust collecting section 3 while being subjected to an attracting force from the positive electrode 11. Therefore, the dielectric 10, which has initially been distributed more on the side of the electrode 12, is uniformly distributed at the upper part of the dust collecting section 3.

According to this embodiment 3, the dielectric 10 can be caused to exist uniformly at the upper part (rear part) of the dust collecting section 3, so that the substance to be collected 9 can be collected enough even at the upper part, resulting in an increase in the collecting efficiency.

Even in the case where the dielectric 10 is charged positively, the distribution of the dielectric sprayed from the spray section is set so that the distribution of the dielectric 10 is made uniform at the rear part of the electrodes 11 and 12.

Next, an embodiment in which the alternating electric field is formed between the electrodes 11 and 12 shown in FIG. 3 will be explained.

(Embodiment 4)

Figure 27:
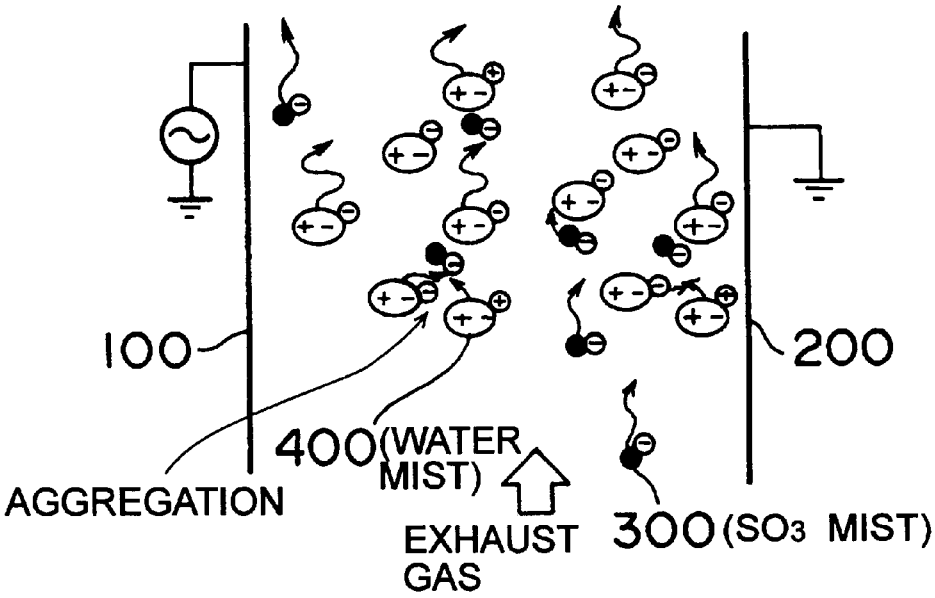
FIG.27 (RELATED ART)
FIG. 27 is an explanatory view typically showing behavior of the particles of dielectric in the alternating electric field in a conventional dust collector.

When the alternating electric field is formed between the electrodes 11 and 12, as described with reference to FIG. 27, there occurs a phenomenon that the particles of dielectric 10 aggregate each other. In order to prevent the aggregation of the particles of dielectric 10, it is necessary only that the mist 10 be charged in advance so as to have the same polarity. This is because the particles of dielectric 10 repel each other due to the charging.

Figure 20:
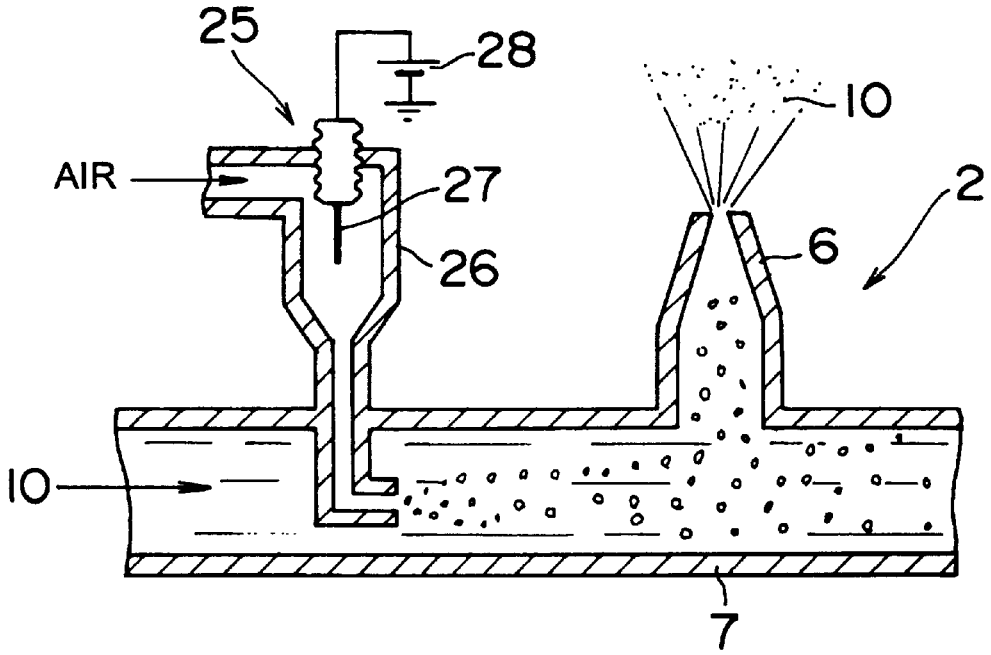
FIG. 20 is a sectional view showing a construction of the spray section used in the dust collector in accordance with the present invention.

Thereupon, in the dust collector of this embodiment 4, the spray section 2 is configured as shown in FIG. 20. This spray section 2 has a charging section 25 provided at a slightly upstream position from the nozzle 6 in the pipe 7 to obtain the charged dielectric 10. The charging section 25 includes an air supply pipe 26 whose tip end is open in the pipe 7, an electrode 27 projecting in the air supply pipe 26, and a direct current source 28 for applying a high voltage to the electrode 27.

When pressurized air is introduced into the air supply pipe 26, the air is provided with a positive charge from the electrode 27, so that the air is ionized positively. The positively ionized air is injected into the dielectric 10 in the pipe 7 as bubbles from the tip end of the air supply pipe 26, so that the dielectric 10 is positively charged by the positive ion of the air. As the result, the positively charged dielectric 10 is sprayed from the nozzle 6.

The positively charged particles of dielectric 10 are subjected to a repelling force therebetween, so that they do not aggregate between the electrodes 11 and 12 in the dust collecting section 3. Therefore, the dielectric 10 exists enough even at the upper part of the dust collecting section 3, thereby increasing the efficiency in collecting the substance to be collected.

Figure 21:
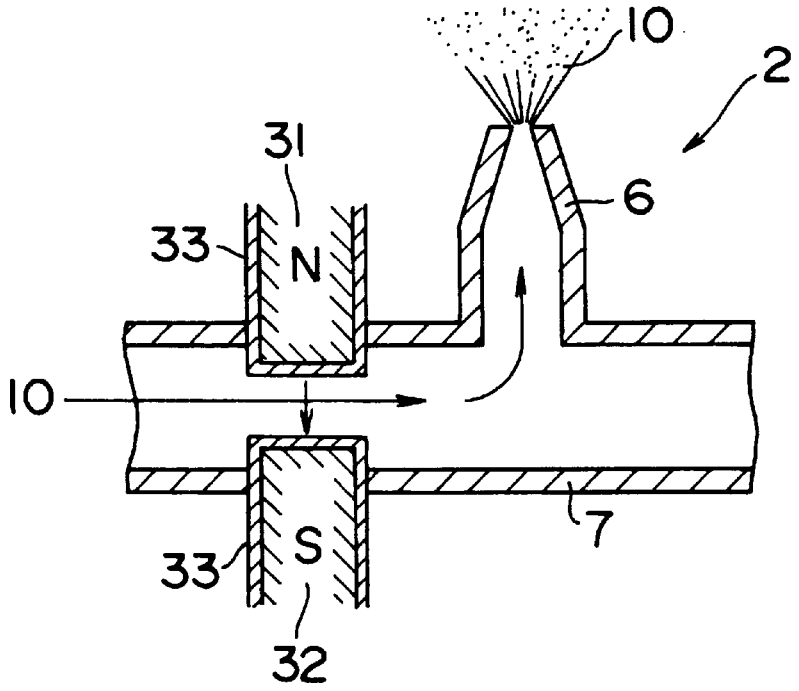
FIG. 21 is a sectional view showing another construction of the spray section used in the dust collector in accordance with the present invention.

The spray section 2 shown in FIG. 21 uses a magnet 31, 32 as a means for obtaining the charged dielectric 10. The magnet 31, 32 is disposed at a slightly upstream position from the nozzle 6 in the pipe 7 so that the tip end portions thereof are opposed to each other in the pipe 7. The magnet 31, 32 is housed in a case 33 having electrical insulating quality and non-magnetism.

Figure 22:
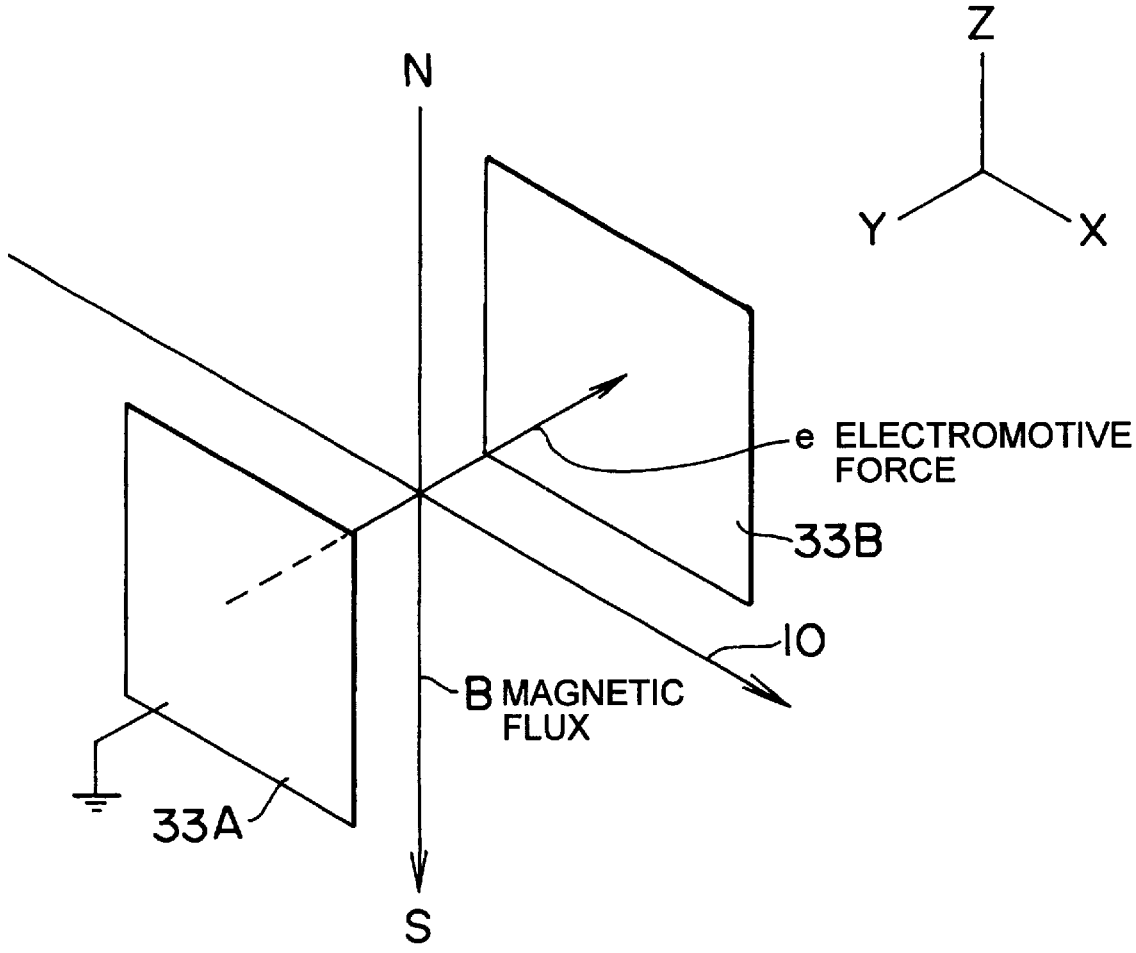
FIG. 22 is a perspective view for explaining the operation of the spray section shown in FIG. 21.

Between the tip end portions of the magnet 31, 32, a magnetic flux B is produced as shown in FIG. 22. The dielectric (water in this example) 10 flows in the X direction perpendicular to the Z direction of the magnetic flux B, so that an electromotive force e in the direction (Y direction) perpendicular to the X and Y directions is created. The electromotive force e is created based on Lorentz's law.

Ions and electrons in the dielectric 10 move in the direction of the electromotive force e or the direction opposite to this according to the polarity thereof. Electrodes 33A and 33B are disposed on one side and the other side of the flow path of the dielectric 10 so as to be perpendicular to the direction of the electromotive force e. The electrode 33A, which is located in the direction opposite to the direction of the electromotive force e, is grounded.

The dielectric 10 passes through an electric field formed between the electrodes 33A and 33B by the electromotive force e. Therefore, the negative ions and electrons in the dielectric 10 flow out via the grounded electrode 33A. As a result, positive ions remain in the dielectric 10 having passed through between the electrodes 33A and 33B. That is to say, the dielectric 10 is charged positively by passing through between the electrodes 33A and 33B.

The positively charged dielectric 10 is supplied to the nozzle 6 shown in FIG. 21, so that the positively charged dielectric 10 is sprayed from the nozzle 6. Thereafter, the positively charged dielectric 10 transfers up to the upper part of the dust collecting section 3 without being aggregated, as described above. Therefore, a shortage of the dielectric 10 at the upper part can be avoided.

In the embodiment shown in FIGS. 20 and 21, the dielectric 10 is charged positively based on the fact that the charging polarity of the substance to be collected 9 in the preliminary charging section 1 is negative. In the case where the charging polarity of the substance to be collected 9 is positive, the dielectric 10 is charged negatively. In this case, the dielectric 10 can be charged negatively by using charging means corresponding to the charging means shown in FIGS. 20 and 21.

(Embodiment 5)

Figure 23:
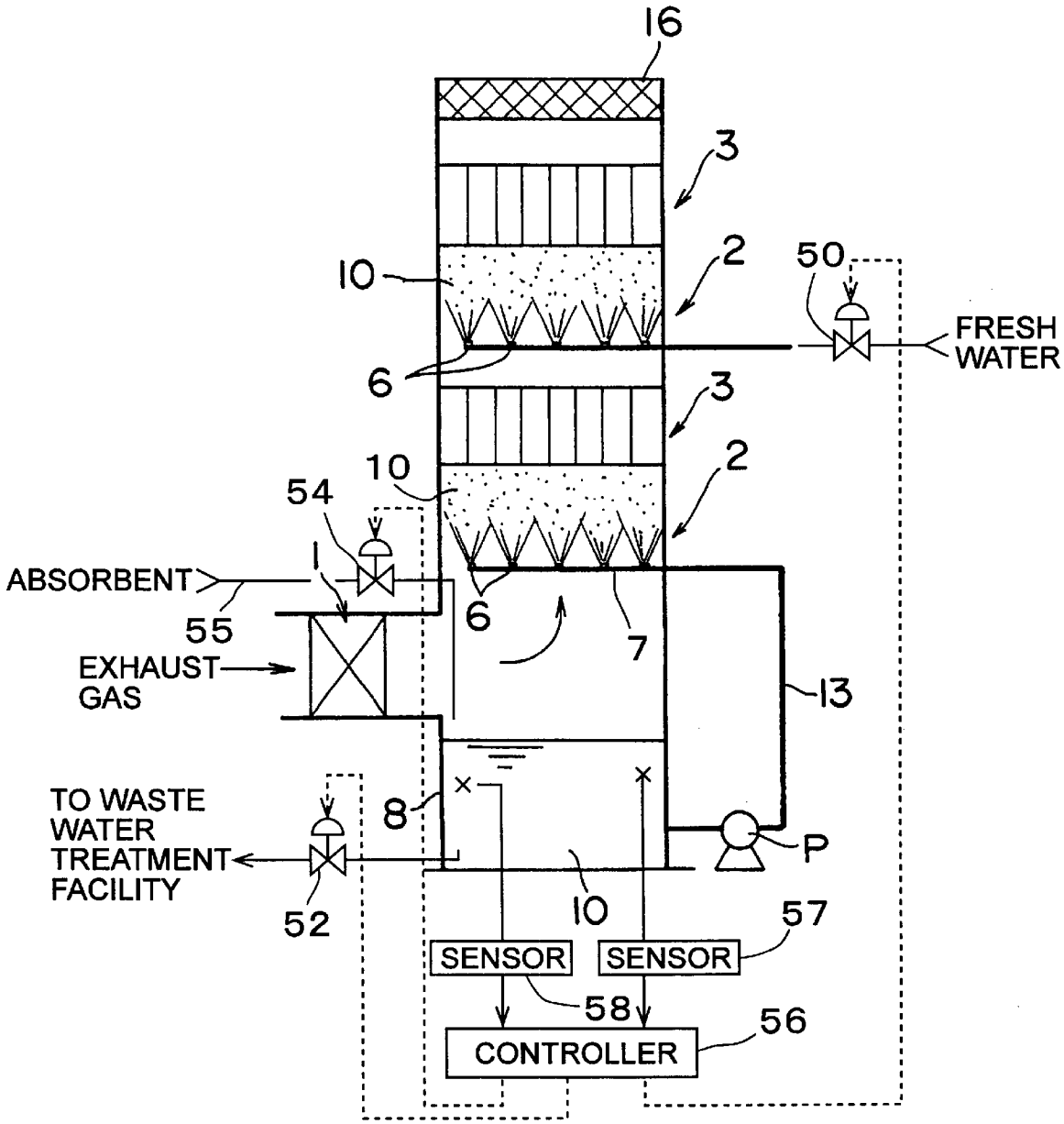
FIG. 23 is a schematic sectional view showing another embodiment of the dust collector in accordance with the present invention.
Figure 24:
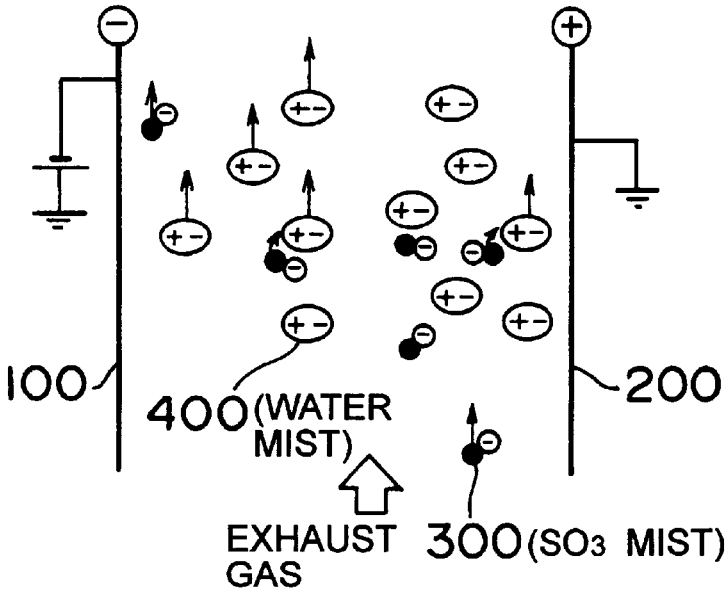
FIG.24 (RELATED ART)
FIG. 24 is an explanatory view showing a general principle of dust collection in a direct current electric field.

FIG. 23 shows an embodiment in which a plurality of stages (two stages in this example) of the pair of the spray section 2 and the dust collecting section 3 are disposed in the direction of the gas flow. This embodiment can be applied to both the case where the direct current electric field is formed between the electrodes 11 and 12 of the dust collecting section 3 and the case where the alternating electric field is formed.

According to this configuration, the substance to be collected that has not been collected in the first-stage dust collecting section 3 is collected in the second-stage dust collecting section 3, so that a very high dust collecting efficiency can be attained.

In this embodiment, circulating water is used as the dielectric 10 supplied to the first-stage spray section 2, and fresh water is used as the dielectric 10 supplied to the second-stage spray section 2. Thus, the outflow of harmful substances contained in the dielectric 10 from the demister 16 can be restrained to the utmost.

In this embodiment as well, as in the case of the dust collector shown in FIG. 1, there are provided dielectric supply/discharge means and absorbent charging means, having the valves 50, 52 and 54, the controller 56, the sensors 57 and 58, and the like. Therefore, the concentration of the reaction product in the dielectric 10 can be controlled so as to be a concentration within a given range, and also the pH value of the dielectric 10 can be controlled so as to be a value within a given range. In this embodiment, however, the fresh water supply valve 50 is provided in the supply pipe 7 of the second-stage spray section 2.

Although the number of stages of the pair of the spray section 2 and the dust collecting section 3 is two in this embodiment, the number of stages can be set at three or more. In this case, fresh water may be supplied to at least the final-stage spray section 2.

Also, when the outflow of harmful substances poses no problem, it is a matter of course that circulating water can be sprayed even in the final-stage spray section 2.

It is preferable that the nozzle 6 of the spray section 2 for spraying the fresh water as the dielectric 10 have a function of being capable of atomizing the fresh water to an average diameter not larger than 50 $\mu$m to decrease the quantity of fresh water used and to increase the dust collecting efficiency. The reason for this will be described below.

In the case where fine dust or mist such as $SO_3$ is the substance to be collected, in order to efficiently collect the substance to be collected, it is necessary only that water mist be caused to float as close as possible to the substance to be collected.

In order to cause the water mist to float close to the substance to be collected, the water mist must be atomized as small as possible. The reason for this is that even when the same quantity of dielectric is sprayed, the smaller the particles of the water mist are, the larger the number of scattered particles is, and resultantly, the water mist can be brought close to the substance to be collected.

Because fresh water contains no foreign matter, the nozzle 6 having a function of being capable of atomizing the fresh water to, for example, an average diameter not larger than 50

μm can be used. As a nozzle having such a function, there are well known a one fluid nozzle in which the spray pressure is high (for example, 5 kg/cm$^2$G) and the foreign matter passing diameter is not larger than 1 mm, a two fluid nozzle additionally using assist air, and the like.

Since a solid matter etc. of the substance collected in the circulating water exist as impurities in the circulating water, when the circulating water is used as the dielectric, the foreign matter passing diameter of nozzle cannot be decreased. Therefore, it is necessary to use a general-purpose one fluid nozzle or two fluid nozzle to spray the circulating water. In this case, the average diameter of the obtained water mist is at the level of about 100 to 200 μm at least.

Comparing the case where a general nozzle for spraying water mist having an average diameter of 170 μm is used with the case where a special nozzle for spraying water mist having an average diameter of 20 μm is used, the necessary quantity of water for obtaining the same dust collecting efficiency differs greatly. In an experiment, it has been verified that the necessary quantity of water in the latter case is decreased to ⅛ or less of the former case.

Figure 25:
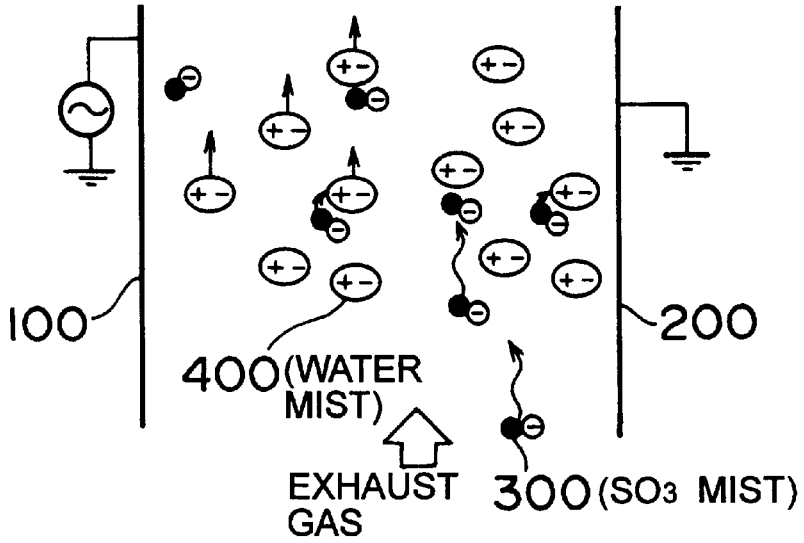
FIG.25 (RELATED ART)
FIG. 25 is an explanatory view showing a general principle of dust collection in an alternating electric field.

The circulating water can be used in a large quantity. However, the quantity of the fresh water used must be decreased for the reason of the necessity of decreasing a utility and for other reasons. In the embodiment shown in FIG. 25, a general-purpose nozzle is used as the nozzle 6 of the first-stage spray section 2, which sprays circulating water as the dielectric 10, and a special nozzle capable of atomizing fresh water to an average diameter not larger than 50 μm is used as the nozzle 6 of the second-stage spray section 2, which sprays the fresh water as the dielectric 10. Thereby, the nozzle is not clogged, thereby maintaining a high dust collecting efficiency, and the quantity of fresh water used is decreased.

Although water is used as the sprayed dielectric 10 in the embodiments described above, the dielectric 10 is selected appropriately according to the composition of the substance to be collected 9. For example, when the gas containing the substance to be collected 9 is an acidic gas such as hydrogen chloride or sulfur dioxide, an alkaline absorbing solution etc. represented by an aqueous solution of sodium hydroxide are used as the dielectric 10, so that gas absorption can also be effected.

Also, the sprayed dielectric 10 is not limited to a liquid. For example, powder of activated carbon etc. having a charging function can be used as the dielectric 10. The dielectric consisting of liquid such as water and the dielectric consisting of the powder can be sprayed at the same time, or a mixture of the liquid and powder can be sprayed.

Further, although the dielectric 10 is sprayed upward in the embodiments described above, the dielectric 10 may be sprayed downward or horizontally.

Still further, although the exhaust gas having passed through the preliminary charging section 1 is moved along the flow path directed from the downside to the upside, the exhaust gas can be moved along a flow path directed horizontally.

However, the movement of the exhaust gas along the flow path directed from the downside to the upside is more advantageous in increasing the efficiency in collecting the substance to be collected. The reason for this is that a nonuniform distribution of the substance to be collected in the exhaust gas caused by the action of the gravity is not formed, so that the substance to be collected is distributed uniformly.

What is claimed is:

1. A dust collector, comprising:

charging means for charging a substance which is contained in a gas and is to be collected;

spray means for spraying a dielectric on said substance to be collected charged by said charging means;

electric field forming means, having first and second electrodes for forming a direct current electric field, for dielectrically polarizing said dielectric sprayed by said spray means by means of said direct current electric field, wherein said polarized dielectric arrests said substance;

dielectric collecting means for collecting said dielectric which has arrested said substance to be collected; and a plurality of corona discharge sections arranged in the flow direction of said gas at given intervals and formed on the opposed surfaces of said first and second electrodes to generate band-shaped uniform corona discharge perpendicular to the gas flow, said dielectric provided with a charge of reverse polarity alternately by the corona discharge.

2. The dust collector according to claim 1, wherein the arrangement interval between said corona discharge sections on said first electrode and the arrangement interval between said corona discharge sections on said second electrode are set so as to be equal to each other, and both of said corona discharge sections have an arrangement phase difference of ½ of said arrangement interval in the flow direction of said gas.

3. The dust collector according to claim 2, wherein the rear parts of said first and second electrodes are extended, and a plurality of said corona discharge sections are formed in the flow direction of said gas on one of these extensions only.

4. The dust collector according to claim 1, wherein the rear parts of said first and second electrodes are extended, and a plurality of said corona discharge sections are formed in the flow direction of said gas on one of these extensions only.

5. A dust collector, comprising:

charging means for charging a substance which is contained in a gas and is to be collected;

spray means for spraying a dielectric on said substance to be collected charged by said charging means;

electric field forming means, having first and second electrodes for forming a direct current electric field, for dielectrically polarizing said dielectric sprayed by said spray means by means of said direct current electric field, wherein said polarized dielectric arrests said substance; and dielectric collecting means for collecting said dielectric which has arrested said substance to be collected, wherein the distribution of said dielectric sprayed by said spray means is set so that the distribution of said dielectric at the rear part of said first and second electrodes is uniformed.

6. The dust collector according to claim 5, wherein a plurality of stages of the pair of said spray means and said electric field forming means are disposed.

7. The dust collector according to claim 6, wherein fresh water is sprayed from spray means of at least the most downstream stage of said plurality of spray means, and circulating water is sprayed from spray means excluding said spray means which sprays fresh water.

8. The dust collector according to claim 7, wherein said spray means of the most downstream stage has a nozzle for atomizing said fresh water to an average diameter not larger than 50 μm.

9. A The dust collector according to claim 5, further comprising:

a dielectric circulating system for supplying said dielectric from a dielectric storage tank to said spray means and for returning the sprayed dielectric from said spray means to said storage tank;

dielectric supply means for supplying a fresh dielectric to said dielectric storage tank;

dielectric discharge means for discharging said dielectric in said dielectric storage tank;

absorbent charging means for charging an absorbent in said dielectric storage tank, said absorbent being used to absorb a reaction product produced by a substance in said gas; and control means for controlling the quantity of dielectric supplied by said dielectric supply means and the quantity of dielectric discharged by said dielectric discharge means so that the concentration of said reaction product exhibits a value within a given range and for controlling the quantity of absorbent charged by said absorbent charging means so that the pH value of said dielectric exhibits a value within a given range.

10. A dust collector, comprising:

charging means for charging a substance which is contained in a gas and is to be collected;

spray means for spraying a dielectric on said substance to be collected charged by said charging means;

electric field forming means, having first and second electrodes for forming a direct current electric field, for dielectrically polarizing said dielectric sprayed by said spray means by means of said direct current electric field, wherein said polarized dielectric arrests said substance; and dielectric collecting means for collecting said dielectric which has arrested said substance to be collected, wherein said spray means is provided with charge providing means for providing said dielectric before being sprayed with a charge having a reverse polarity of the charging polarity of said substance to be collected.

11. The dust collector according to claim 10 wherein said charge providing means is configured so as to supply ionized air to said dielectric before being sprayed.

12. The dust collector according to claim 10 wherein said charge providing means is configured so that magnetism in the direction perpendicular to the flow direction of said dielectric is applied to said dielectric before being sprayed.

13. The dust collector according to claim 10, wherein a plurality of stages of the pair of said spray means and said electric field forming means are disposed.

14. The dust collector according to claim 10, further comprising:

a dielectric circulating system for supplying said dielectric form a dielectric storage tank to said spray means and for returning the sprayed dielectric from said spray means to said storage tank;

dielectric supply means for supplying a fresh dielectric to said dielectric storage tank;

dielectric discharge means for discharging said dielectric in said dielectric storage tank;

absorbent charging means for charging an absorbent in said dielectric storage tank, said absorbent being used to absorb a reaction product produced by a substance in said gas; and control means for controlling the quantity of dielectric supplied by said dielectric supply means and the quantity of dielectric discharged by said dielectric discharge means so that the concentration of said reaction product exhibits a value within a given range and for controlling the quantity of absorbent charged by said absorbent charging means so that the pH value of said dielectric exhibits a value within a given range.

15. A dust collector comprising:

a charging unit configured to charge a substance which is contained in a gas and is to be collected;

a spray unit configured to spray a dielectric on said substance to be collected;

an electric field forming device configured with first and second electrodes to form a direct current electric field, said direct current electric field dielectrically polarizing said dielectric sprayed by said spray unit such that a polarized dielectric arrests said substance;

a dielectric collector configured to collect said dielectric which has arrested said substance to be collected;

a plurality of corona discharge sections arranged in a flow direction of said gas at given intervals, formed on opposed surfaces of said first and second electrodes, and configured to generate a band-shaped uniform corona discharge perpendicular to the gas flow; and said dielectric provided alternately with a charge of reverse polarity by the corona discharge.

16. A dust collector comprising:

a charging unit configured to charge a substance which is contained in a gas and is to be collected;

a spray unit configured to spray a dielectric on said substance to be collected charged by said charging unit;

an electric field forming device configured with first and second electrodes to form a direct current electric field, said direct current electric field dielectrically polarizing said dielectric sprayed by said spray unit such that a polarized dielectric arrests said substance;

a dielectric collecting device configured to collect said dielectric which has arrested said substance to be collected; and said spray unit configured to provide a spray distribution of said dielectric sprayed such that the distribution of said dielectric at a rear part of said first and second electrodes is uniform.

17. A dust collector comprising:

a charging unit configured to charge a substance which is contained in a gas and is to be collected;

a spray unit configured to spray a dielectric on said substance to be collected charged by said charging unit;

an electric field forming device configured with first and second electrodes to form a direct current electric field, said direct current electric field dielectrically polarizing said dielectric sprayed by said spray unit such that a polarized dielectric arrests said substance;

a dielectric collecting device configured to collect said dielectric which has arrested said substance to be collected; and said spray unit is provided with a charge providing unit configured to provide the dielectric before being sprayed with a charge having a reverse polarity of a charging polarity of said substance to be collected.

* * * * *